US008973165B1

(12) United States Patent
Zaki

(10) Patent No.: US 8,973,165 B1
(45) Date of Patent: Mar. 10, 2015

(54) ADJUSTABLE COLLAR STAY

(75) Inventor: Sherif Zaki, Houston, TX (US)

(73) Assignee: Brightmind, LLC, Houston, TX (US)

( * ) Notice: Subject to any disclaimer, the term of this patent is extended or adjusted under 35 U.S.C. 154(b) by 792 days.

(21) Appl. No.: 13/214,909

(22) Filed: Aug. 22, 2011

Related U.S. Application Data

(60) Provisional application No. 61/376,383, filed on Aug. 24, 2010.

(51) Int. Cl.
*A41B 3/00* (2006.01)

(52) U.S. Cl.
USPC ..... 2/132; 2/256

(58) Field of Classification Search
USPC ..... 2/60, 129, 132, 255, 256
See application file for complete search history.

(56) References Cited

U.S. PATENT DOCUMENTS

| | | | | | |
|---|---|---|---|---|---|
| 811,326 | A * | 1/1906 | Reynolds | ..... | 2/134 |
| 2,799,024 | A * | 7/1957 | Oscard | ..... | 2/132 |
| 2,899,681 | A * | 8/1959 | Oscard | ..... | 2/132 |
| 2,936,461 | A * | 5/1960 | Robinson | ..... | 2/132 |
| 3,075,202 | A * | 1/1963 | Rubio | ..... | 2/132 |
| 4,118,803 | A | 10/1978 | Blau | | |
| 6,748,602 | B1 | 6/2004 | Barnes | | |
| 6,986,165 | B2 | 1/2006 | Neff et al. | | |
| 2007/0204374 | A1 * | 9/2007 | Bier et al. | ..... | 2/60 |
| 2012/0227163 | A1 | 9/2012 | Schottenstein | | |

* cited by examiner

*Primary Examiner* — Shaun R Hurley
*Assistant Examiner* — Andrew W Sutton
(74) *Attorney, Agent, or Firm* — Buskop Law Group, PC; Wendy Buskop

(57) ABSTRACT

An adjustable collar stay having a lower member engaged with an upper member, wherein the upper member can be extendable and retractable from the lower member for use with a variety of collar sizes and styles. The lower member and upper member can have locking mechanisms for retaining a position of extension or retraction. The adjustable collar stay can maintain a position of a shirt collar.

19 Claims, 13 Drawing Sheets

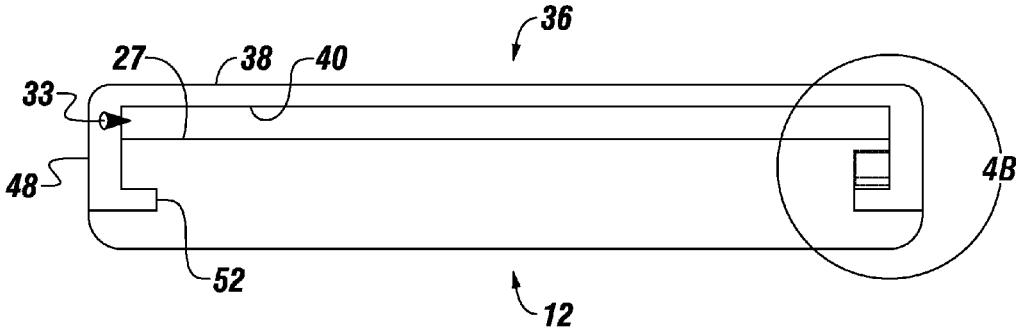
FIGURE 4A
FIGURE 4B
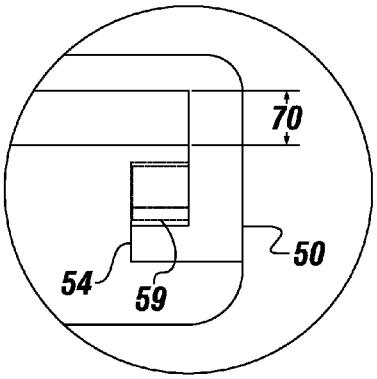

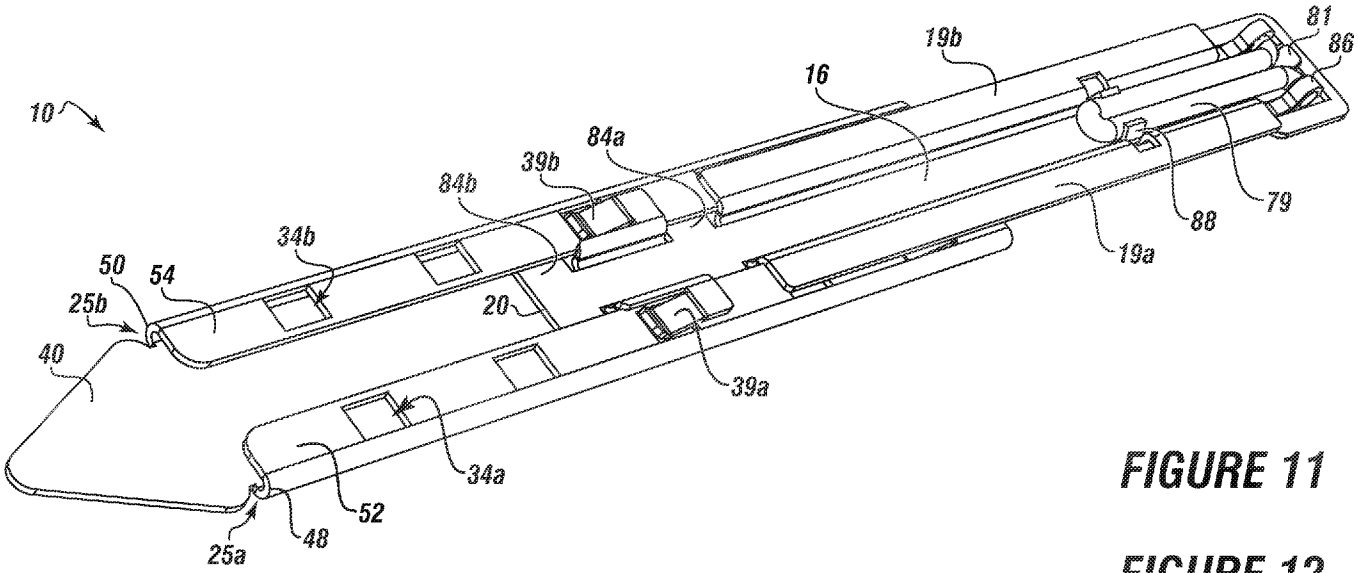
FIGURE 11
FIGURE 12
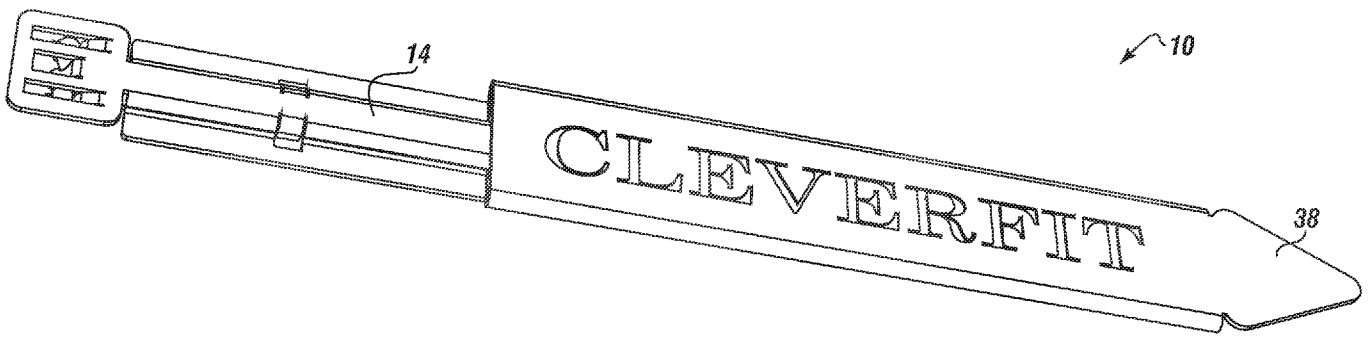

ADJUSTABLE COLLAR STAY

CROSS REFERENCE TO RELATED APPLICATION

The present application is a non-provisional of and claims priority to and the benefit of U.S. Provisional Patent Application No. 61/376,383 filed on Aug. 24, 2010, entitled "ADJUSTABLE COLLAR STAY AND METHOD OF USE". This application is incorporated in its entirety herewith.

FIELD

The present embodiments generally relate to an adjustable collar stay that can be adjusted for use with various shirts having various sizes and styles of collars.

BACKGROUND

A need exists for an adjustable collar stay that can be moved between a retracted position and an extended position, enabling the adjustable collar stay to be used with different sizes and styles of shirts and shirt collars.

A need exists for an adjustable collar stay that can be quickly adjusted using a single hand.

A need exists for an adjustable collar stay that can be re-used with multiple shirts.

The present embodiments meet these needs.

BRIEF DESCRIPTION OF THE DRAWINGS

The detailed description will be better understood in conjunction with the accompanying drawings as follows:

FIGS. 4A-4B depict rear views of the adjustable collar stay.

FIG. 11 depicts a bottom view of an embodiment of the upper member of FIGS. 9A-9C engaged with the lower member of FIGS. 10A-10B.

FIG. 12 depicts a top view of an embodiment of the upper member of FIGS. 9A-9C engaged with the lower member of FIGS. 10A-10B.

Figure 1:
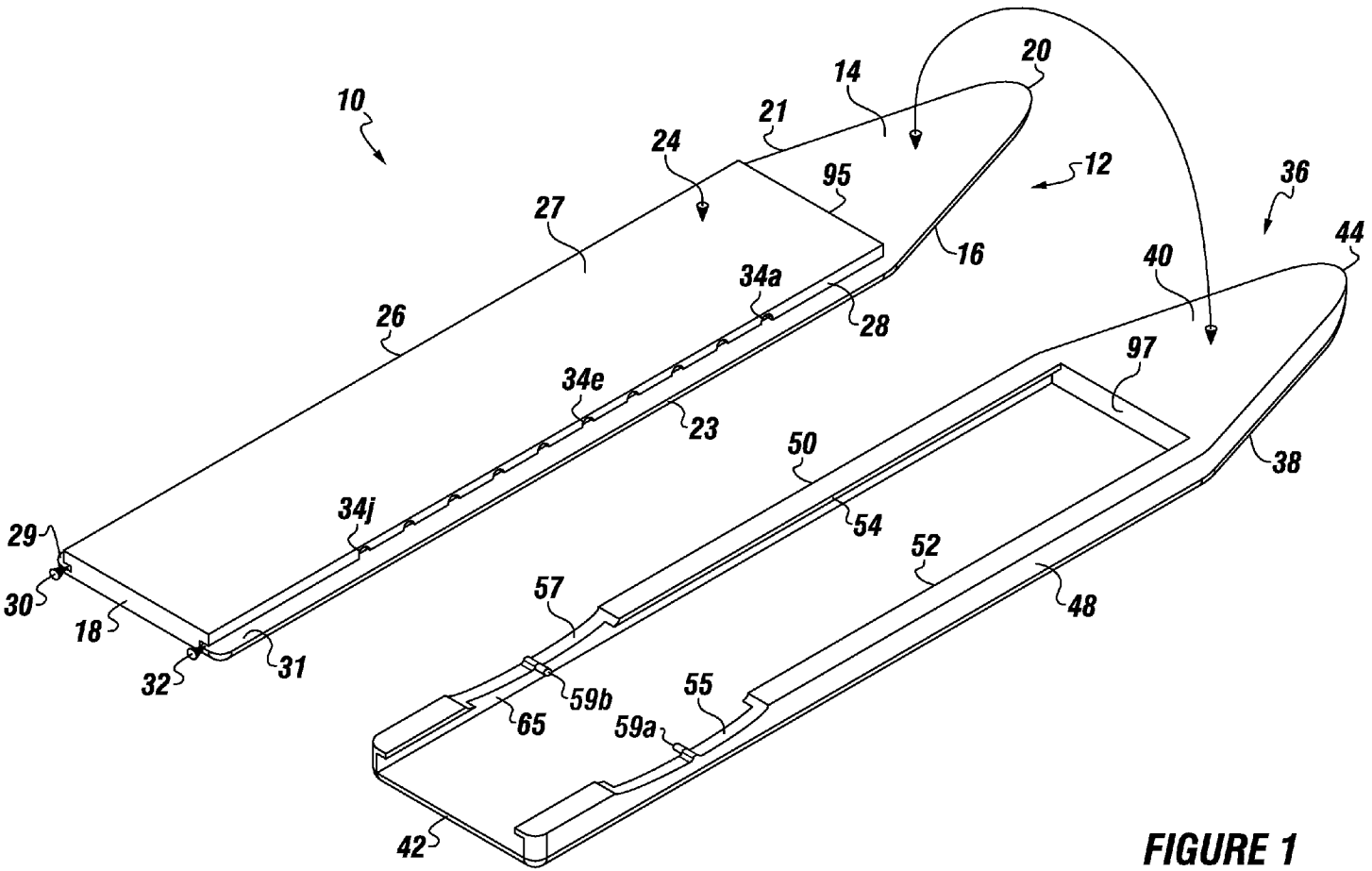
FIG. 1 is a depiction of the adjustable collar stay with an upper member disconnected from a lower member.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to an adjustable collar stay that can be adjusted to fit a variety of shirt collars of various sizes, shapes, and styles.

The adjustable collar stay can include a lower member for engaging with an upper member.

The adjustable collar stay can be small, lightweight, easy to use, adjustable to fit a variety of collar types and sizes, strong, durable, intuitive to use, sleek and aesthetically pleasing in appearance, and can fit and function ergonomically.

The adjustable collar stay can be adjusted between a retracted position and an extended position. In the retracted position, the adjustable collar stay can have an overall length ranging from about 0.5 inches to about 3.5 inches. In the extended position, the adjustable collar stay can have an overall length ranging from about 1 inch to about 4 inches or more. The above dimensions are for illustrative purposes only, as the adjustable collar stay can be any size necessary for fitting any shirt collar.

The upper member and lower member can be assembled together. The upper member and lower member can have the same shape or different shapes.

The lower member can be thin. For example, the lower member can have a thickness ranging from about 0.015 inches to about 0.175 inches. The lower member can have a lower member back surface, which can have a width ranging from about 0.10 inches to about 0.5 inches.

The lower member can have a lower member front end opposite a lower member back end, which can taper to a lower member nose. The lower member nose can be a round nose, blunt nose, pointed nose, flat plane, rounded circle, triangle, or another angular or curvilinear shape.

The lower member can be substantially flat, and can include a lower member top surface and a lower member bottom surface opposite the lower member top surface.

The lower member can include a lower member back end and a lower member front end opposite the lower member back end. The lower member front end can be tapered.

The lower member can also include a lower member first side connecting between the lower member back end and the lower member front end, and between a lower member top surface and the lower member bottom surface.

The lower member can include a lower member second side connecting between the lower member back end and the lower member front end, and between the lower member top surface and the lower member bottom surface opposite the lower member first side.

The lower member can include a lower engagement mechanism for engaging with the upper member. The lower engagement mechanism can be a track arm, a raised portion, or another mechanism configured to movably engage with a portion of the upper member. The lower engagement mechanism can be connected to or formed on a portion of the lower member.

In one or more embodiments, the raised portion can be connected to or formed on the lower member top surface between the lower member back end and the lower member front end. For example, in production of the lower member, the lower member top surface can be machined down to form the raised portion.

The raised portion can include a raised portion first side, raised portion second side, raised portion front side, raised portion back side, and raised portion top. The raised portion can be disposed equidistantly between the lower member first side and the lower member second side.

A first ledge can be formed on or connected to the lower member top surface between the raised portion and lower member first side. A second ledge can be formed on or connected to the lower member top surface between the raised portion and lower member second side.

A first channel can be formed within the raised portion first side. The first channel can extend from one end of the raised portion, proximate the lower member back end, to the opposite end of the raised portion, closer to the lower member front end.

A second channel can be formed within the raised portion second side. The second channel can extend from one end of the raised portion, proximate the lower member back end, to the opposite end of the raised portion, closer to the lower member front end.

The first channel and second channel can each include a plurality of engagement and resistance sites, which can be formed therein. The plurality of engagement and resistance sites can be formed as teeth-like structures formed within the channels, gear like structures formed within the channels, bumps formed within the channels, recessed portions formed within the channels, grooves formed within the channels, or any structure formed within the channels and configured to receive and retain a locking means of the upper member.

A height of each channel can be smaller proximate the lower member back end. For example, the channels can be tapered, such that the heights of the channels are smaller proximate the lower member back end. The height of each channel can also be tapered proximate the lower member front end, such that a central portion of each channel has a greater height than the tapered portions at the ends of the channels.

The upper member can be extendably, retractably, movably, and/or slidably engaged with the lower member.

The upper member can have a width ranging from about 0.1 inches to about 0.5 inches, and a height ranging from about 0.015 inches to about 0.175 inches. The dimensions of the upper member and lower member provided herein are for illustrative purposes only, as the components of the adjustable collar stay can be any size necessary for fitting any shirt collar.

The upper member can include an upper member top surface and an upper member bottom surface opposite the upper member top surface.

The upper member can include an upper member back end and an upper member front end opposite the upper member back end. The upper member front end can be tapered.

The upper member can include an upper member first side connecting between the upper member back end and the upper member tapered front end, and between the upper member top surface and the upper member bottom surface.

The upper member can include an upper member second side connecting between the upper member back end and the upper member tapered front end, and between the upper member top surface and the upper member bottom surface opposite the upper member first side.

The upper member can include a first upper side extension that can be connected to and can extend perpendicular from the upper member first side. The first upper side extension can extend downwards from the upper member bottom surface.

The upper member can include a second upper side extension that can be connected to and can extend perpendicular from the upper member second side. The second upper side extension can extend downwards from the upper member bottom surface.

The upper member can include a first upper lip that can be connected to the first upper side extension opposite the upper member first side. The first upper lip can extend perpendicular to the first upper side extension and towards the second upper side extension below the upper member bottom surface. The first upper lip can be movingly and/or slidingly engaged within the first channel.

The upper member can include a second upper lip that can be connected to the second upper side extension opposite the upper member second side. The second upper lip can extend perpendicular to the second upper side extension and towards the first upper side extension below the upper member bottom surface. The second upper lip can be movingly and/or slidingly engaged within the second channel.

In one or more embodiments, the first upper lip and the second upper lip can each have a rear portion and a front portion. Each front portion can have a first width and each rear portion can have a second width proximate the upper member back end. The second width can be larger than the first width.

The first channel and second channel can each have a front channel portion and a rear channel portion. Each front channel portion can have a first channel width, and each rear channel portion can have a second channel width proximate the lower member back end. The second channel width can be larger than the first channel width.

The transition within the channels from the second channel width to the first channel width can form a back stop within each channel. The second channel width can be configured to receive the second width of the first upper lip and second upper lip, and the first channel width can be configured to receive the first width of the first upper lip and second upper lip.

In operation, rear portions of the upper lips can slide within the channels until they engage with the back stops. As such, the back stops can provide a sturdy engagement between the upper member and the lower member.

The upper member can include a first recessed portion that can be formed within the first upper side extension and the first upper lip. The first recessed portion can be formed as an arc, a curvilinear shape, or another shape. With the upper member attached to the lower member, the first recessed portion can expose a portion of the lower member.

The upper member can include a second recessed portion formed within the second upper side extension and the second upper lip. The second recessed portion can be formed as an arc, a curvilinear shape, or another shape. With the upper member attached to the lower member, the second recessed portion can expose a portion of the lower member.

With the upper member attached to the lower member, the lower member bottom surface can function as a gripping point or can include a gripping point. In one or more embodiments, the gripping point can be formed as a concavity or a depression on the lower member bottom surface. The gripping point can have a diameter ranging from about 0.1 inches to about 0.5 inches.

In operation, a user can use at least one finger to engage the lower member, such as at the lower member bottom surface or the gripping point. The user can then compress the upper member, such as at a compression site of the upper member, and can slide the upper member within channels of the lower member. The user can apply pressure downwardly on the compression site, which can be followed by a slight rotation or redirection of pressure by the user's finger or thumb, which can cause a horizontal movement of the upper member with respect to the lower member. The upper member can be moved while the lower member is held steady to extend or retract the adjustable collar stay axially; thereby enabling versatile use of the adjustable collar stay with a plurality of shirts having different styles and sizes.

In one or more embodiments, the gripping point and the compression site can be or can include one or more grooves or one or more raised ridges that can provide a user with a frictional gripping surface.

The lower member can include a lower locking mechanism and the upper member can include an upper locking mechanism. The lower locking mechanism can be configured to engage with the upper locking mechanism to retain a position of the upper member relative to the lower member. The lower locking mechanism and the upper locking mechanism can be tabs, engagement and resistance sites, holes, or combinations thereof. The lower locking mechanism can be connected to or formed on a portion of the lower member.

The upper locking mechanism can connected to or formed on a portion of the upper member. For example, the upper locking mechanism can include a locking means that can be disposed on or connected to an inner surface of the first upper lip at the first recessed portion, the second upper lip at the second recessed portion, or combinations thereof.

The locking means can be formed as a tab, a knob, a ball, an extension, a node, or any other shape configured to engage within engagement and resistance sites on the lower member. In one or more embodiments, the locking means can be a ball-shaped locking member that can engage in the engagement and resistance sites. The locking means can be a cylinder with a diameter ranging from about 0.005 inches to about 0.175 inches.

The locking means can be configured to sequentially engage one of the plurality of engagement and resistance sites within the first channel, second channel, or combinations thereof for locking the upper member in position relative to the lower member.

The upper member can include more than one locking means for simultaneous engagement of multiple engagement and resistance sites.

In one or more embodiments, the compression site of the upper member can be formed on the upper member top surface, such as over the locking means. The compression site can be configured to allow a user to mechanically compress the upper member towards the lower member, such that the upper member temporarily flexes.

For example, the compression site can be a concave portion or a depression of the upper member top surface sized and configured such that a user can dispose his or her thumb therein to exert a compressive force upon the upper member. The compression site can have a diameter ranging from about 0.1 inches to about 0.5 inches.

In one or more embodiments, with the upper member attached to the lower member, the adjustable collar stay can include a cavity that can be formed between the upper member and lower member. The cavity can be formed between the upper member bottom surface and raised portion top surface.

The cavity can have a dimension or height configured to allow the upper member to mechanically compress towards the lower member for a maximum predetermined distance. The maximum predetermined distance can be a distance sufficient to allow the locking means to disengage from one of the plurality of engagement and resistance sites, without being sufficient to allow the locking means to extend past a front stop and back stop within the first channel, second channel, or combinations thereof.

For example, upon mechanical compression of the upper member towards the lower member, the upper member can flex and/or extend into the cavity. At a point of the extension of the upper member into the cavity, the upper member bottom surface can engage the raised portion top; thereby preventing any further compression of the upper member beyond the dimension of the cavity. As such, the upper member and locking means can be moved within the first channel and second channel, and the locking means can be engaged with another of the plurality of engagement and resistance sites.

The cavity can have a length ranging from about 0.5 inches to about 2.5 inches, a height ranging from about 0.015 inches to about 0.175 inches, and a depth ranging from about 0.015 inches to about 0.5 inches.

The cavity can have a shape that allows for mechanical compression of the upper member, thereby allowing for smooth shifting of the upper member axially over the lower member, and allowing for retraction and extension of the adjustable collar stay. As such, the adjustable collar stay can provide adaptability and versatility useful for many different sizes and styles of shirts.

In one or more embodiments, upon mechanical compression of the upper member, the first ledge can engage the first upper lip and the second ledge can engage the second upper lip. The engagement of the ledges with the upper lips can resist movement of the upper member to resistively stabilize the upper member on the lower member; thereby allowing the upper member to compressively extend or flex into the cavity. As such, the locking means can disengage from one of the plurality of engagement and resistance sites.

In one or more embodiments, the upper member can be configured to slidingly retract and extend within the first channel and second channel such that the adjustable collar stay can have a length ranging from about 0.5 inches in a retracted position to about 5 inches in an extended position.

In one or more embodiments, the cavity can have the back stop disposed therein. The back stop in the cavity can function to stop movement of the locking means; thereby stopping movement of the upper member with respect to the lower member. For example, portions of the channels with the smaller height proximate the lower member back end can be less than a height of the locking means, thereby forming the back stop.

The locking means can be configured to not fit within the portion of the channels with the smaller height, allowing the back stop to prevent movement of the locking means in a first direction beyond the back stop.

In one or more embodiments, the front stop can be formed in the first channel, second channel, or combinations thereof opposite the back stop. The front stop can be formed substantially the same as the back stop, such as by a tapering of the channels. The front stop can prevent movement of the locking means in a second direction beyond the front stop. The front stop can be formed in the cavity of the lower member. The front stop can stop movement of the locking means and the upper member.

One or more embodiments can include a stabilizing arm that can be pivotably attached to the lower member, rotatably attached to the lower member, or combinations thereof.

The stabilizing arm can be attached to the lower member bottom surface or lower member top surface. For example, a disc can be rotatably attached to the lower member, and the stabilizing arm can be connected to the disc.

The stabilizing arm can rotate with the disc when the disc is rotated. The stabilizing arm can also be pivotably attached to the disc, such that the stabilizing arm can pivot away from the lower member.

In one or more embodiments, the connection of the stabilizing arm to the disc and/or to the lower member can include a ratcheting mechanism for locking a position of the stabilizing arm along a pivoting arc of the stabilizing arm. The stabilizing arm can be pivotable one hundred eighty degrees about the disc.

One or more embodiments relate to a shirt having a collar with a collar stay slot on each side of the collar. The shirt can have an adjustable collar stay disposed within each collar stay slot.

In one or more embodiment, the adjustable collar stay can be made of a stainless steel, a zinc alloy, an aluminum alloy, another metal, another metal alloy, a ferrous metal, a non-ferrous metal, a non-deforming plastic, a compressible plastic, a flexible plastic, another plastic, a polymer, a reinforced polymer, a coated polymer, another material, or combinations thereof.

One or more embodiments of the adjustable collar stay can be made by four slide mechanical or metal stamping, or by another method.

In one or more embodiments, the locking means can be formed on or connected to a side of the raised portion of the lower member, rather than on the upper member. The plurality of engagement and resistance sites can be formed on or connected along an inner surface of an extension of the upper member. The recesses of the plurality of engagement and resistance sites can have an open end facing the upper member bottom surface. In operation, when the upper member is not compressed, the locking means of the lower member can be disposed within one of the plurality of engagement and resistance sites. Upon compression of the upper member, the plurality of engagement and resistance sites can extend below the locking means, thereby unlocking the upper member from the lower member. As such, the upper member can be moved with respect to the lower member to give the adjustable collar stay a desired length. The compression of the upper member can then be released, decompressing the upper member and engaging the locking means within another of the plurality of engagement and resistance sites of the lower member, thereby locking the upper member to the lower member.

Turning now to the Figures, FIG. 1 depicts an embodiment of the adjustable collar stay 10 with the lower member 12 disengaged from the upper member 36.

The lower member 12 can include a lower member top surface 14, a lower member bottom surface 16, a lower member back end 18, a lower member front end 20 that can be tapered, a lower member first side 21, and a lower member second side 23.

The lower member 12 can have an engagement mechanism, such as a raised portion 24 connected to or formed on the lower member top surface 14. The raised portion 24 can include a raised portion first side 26, a raised portion second side 28, a raised portion top side 27, and a raised portion front side 95.

A first ledge 29 can be formed on the lower member top surface 14, and a second ledge 31 can be formed on the lower member top surface 14.

A first channel 30 can be formed within the raised portion first side 26, and a second channel 32 can be formed within the raised portion second side 28.

The lower member 12 can include a lower locking mechanism. For example, the first channel 30 and second channel 32 can include a plurality of engagement and resistance sites, such as engagement and resistance sites 34*a*, 34*e*, and 34*j*.

The upper member 36 can include an upper member top surface 38, an upper member bottom surface 40, an upper member back end 42, an upper member tapered front end 44, a first upper side extension 48, a second upper side extension 50, a first upper lip 52, a second upper lip 54, a first recessed portion 55, a second recessed portion 57, an inner wall 97, a first locking means 59*a* disposed on or connected to an inner surface of the first upper lip 52 at the first recessed portion 55, and a second locking means 59*b* disposed on or connected to an inner surface 65 of the second upper lip 54 at the second recessed portion 57.

Figure 2A:
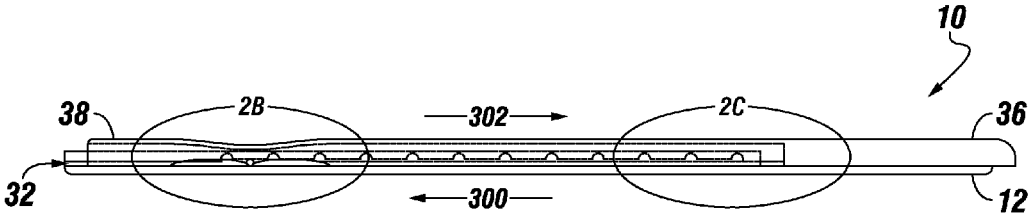
FIGS. 2A-2C depict side views of the adjustable collar stay in transition between a retracted position and an extended position.
Figure 2B:
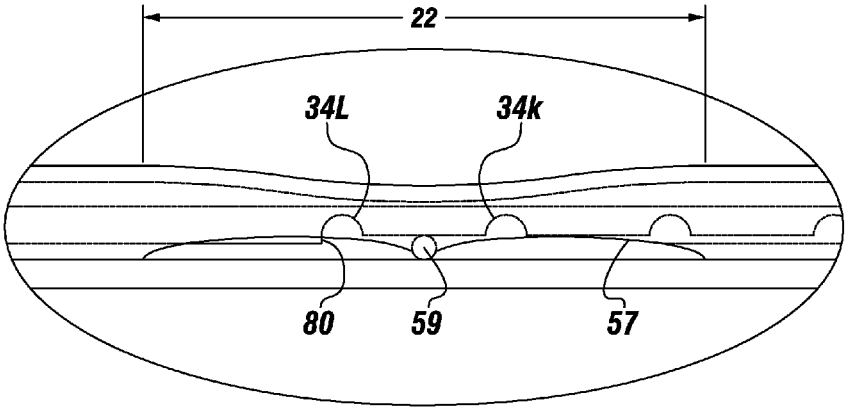
Figure 2C:
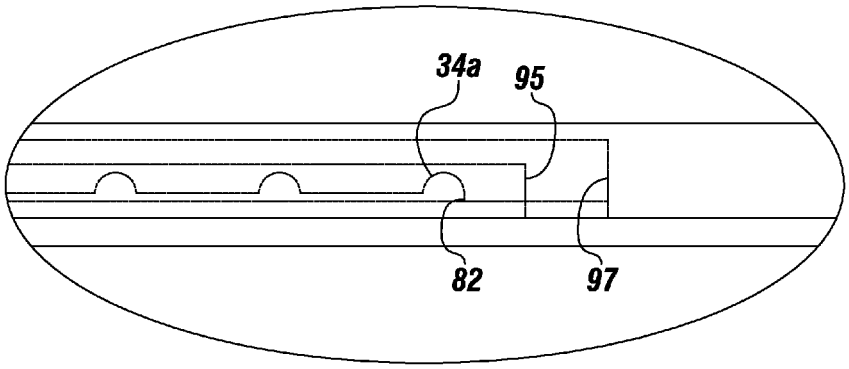

FIGS. 2A-2C depict an embodiment of the adjustable collar stay 10 with the upper member 36 engaged with the lower member 12. The adjustable collar stay 10 is depicted in transition between two engagement and resistance sites 34L and 34*k*.

A compression site 22 can be formed on the upper member top surface 38 over the locking means 59. As shown, the compression site 22 can be used to mechanically compress the upper member 36 towards the lower member 12.

The locking means 59 is depicted in transition within the second channel 32 between engagement and resistance site 34L and engagement and resistance site 34*k*.

A front stop 82 can be formed in the second channel 32 proximate the engagement and resistance site 34*a* for preventing movement of the locking means 59 in a second direction 302 beyond the front stop 82.

A back stop 80 can prevent movement of the locking means 59 in a first direction 300.

Also, in operation, the inner wall 97 of the upper member 36 can engage the raised portion front side 95 of the lower member 12.

The second recessed portion 57 can expose a portion of the lower member 12.

In operation, a user can grip the lower member 12, such as along the lower member bottom surface while simultaneously compressing the upper member 36 at the compression site 22. The first recessed portion, not shown in this Figure, and the second recessed portion 57 can allow the upper member 36 to flex during compression at the compression site 22 in order to move the upper member 36 within the first channel, not shown in this Figure, and the second channel 32 to extend or retract the adjustable collar stay 10.

Figure 3A:
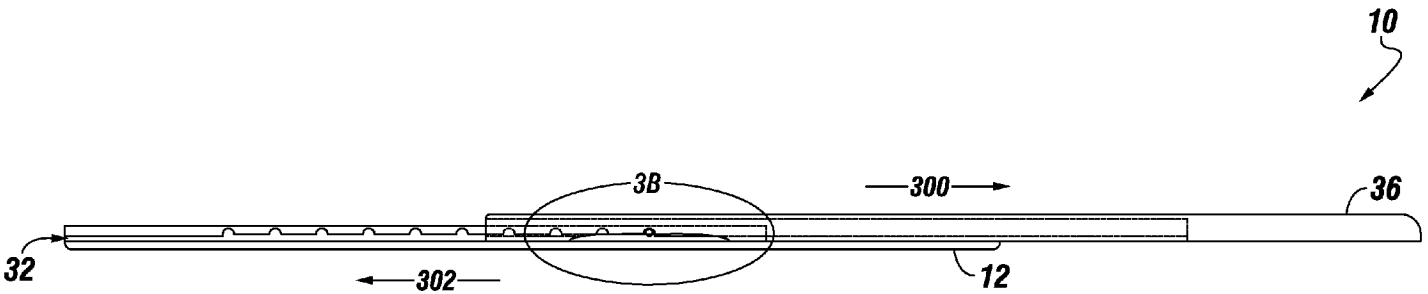
FIGS. 3A-3B depict side views of the adjustable collar stay in an extended position.
Figure 3B:
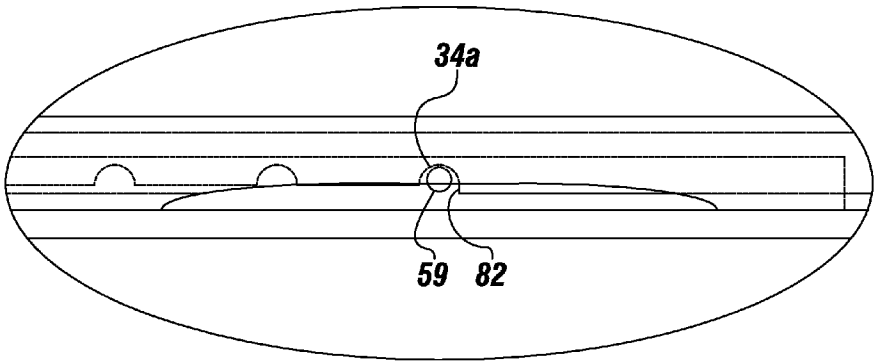

FIGS. 3A-3B depict an embodiment of the adjustable collar stay 10 with the upper member 36 engaged with the lower member 12. The adjustable collar stay 10 is depicted in an extended position. Relative to the position of the upper member 36 depicted in FIGS. 2A-2C, the upper member 36 has been moved within the second channel 32 in the first direction 300 to extend the adjustable collar stay 10.

The upper member 36 can be moved back in the second direction 302 to retract the adjustable collar stay 10.

The locking means 59 can be engaged within the engagement and resistance site 34*a* proximate the front stop 82.

FIGS. 4A-4B depict an end view of an embodiment of the upper member 36 engaged with the lower member 12.

A cavity 33 can be formed between the upper member bottom surface 40 and the raised portion top side 27. The cavity 33 can have a height 70.

In operation, upon mechanical compression of the upper member 36 towards the lower member 12, the upper member 36 can extend into the cavity 33, and the raised portion top side 27 can prevent the compression of the upper member 36 beyond the height 70 of the cavity 33.

Also shown are the upper member top surface 38, the first upper side extension 48, the first upper lip 52, and the second upper lip 54. The locking means 59 can be formed on an inner surface of the second upper side extension 50.

Figure 5A:
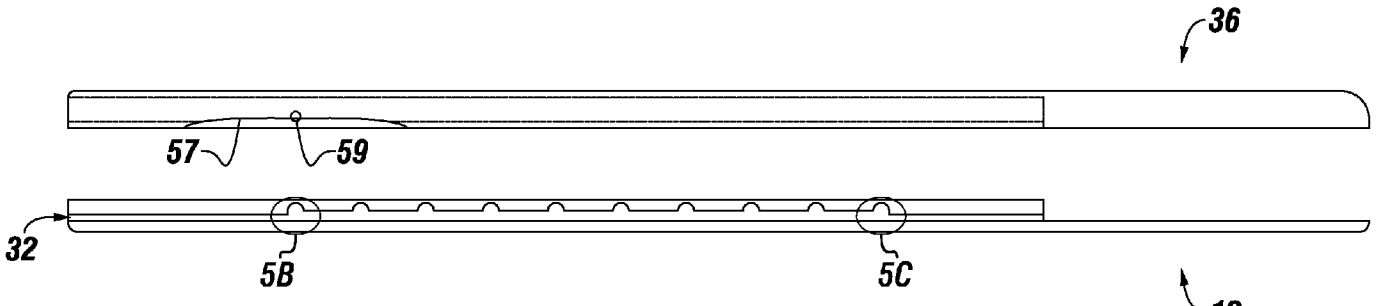
FIGS. 5A-5C depict side views of the adjustable collar stay with the upper member disconnected from the lower member.
Figure 5B:
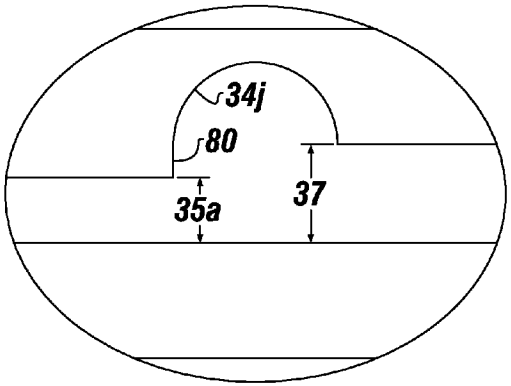
Figure 5C:
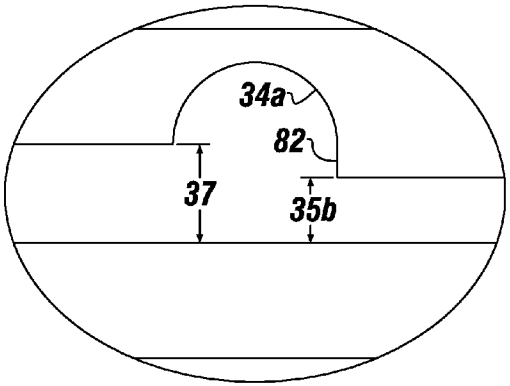

FIGS. 5A-5C depict an embodiment with the upper member 36 disengaged from the lower member 12.

The second channel 32 can be tapered such that the second channel 32 has first height 35*a*, a second height 35*b*, and a third height 37.

The first height 35*a* and second height 35*b* can be equal, and can both be less than the third height 37.

The adjustable collar stay can be configured such that the locking means 59 at the second recessed portion 57 can slide within the portion of the second channel 32 having the third height 37, without being enabled to slide within the portion of the second channel 32 having the first height 35*a* and second height 35*b*.

Also shown are the front stop 82, the back stop 80, and engagement and resistance sites 34*a* and 34*j*.

Figure 6:
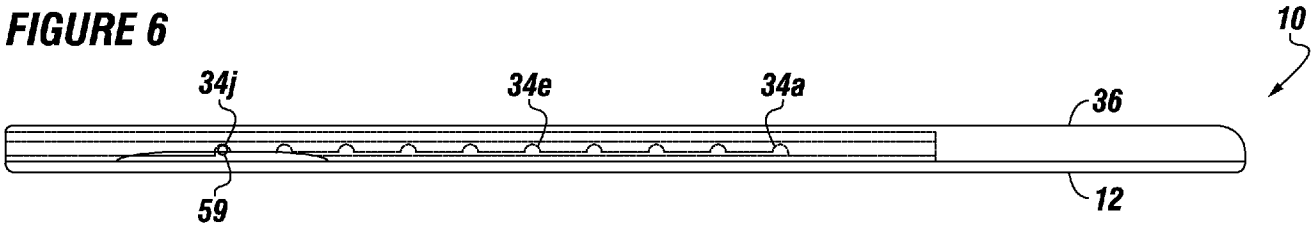
FIG. 6 depicts a side view of the adjustable collar stay in a retracted position.

FIG. 6 depicts the adjustable collar stay 10 in a fully retracted position with the locking means 59 of the upper member 36 engaged within the engagement and resistance site 34*j* of the lower member 12. Also depicted are engagement and resistance sites 34*a* and 34*e*.

Figure 7B:
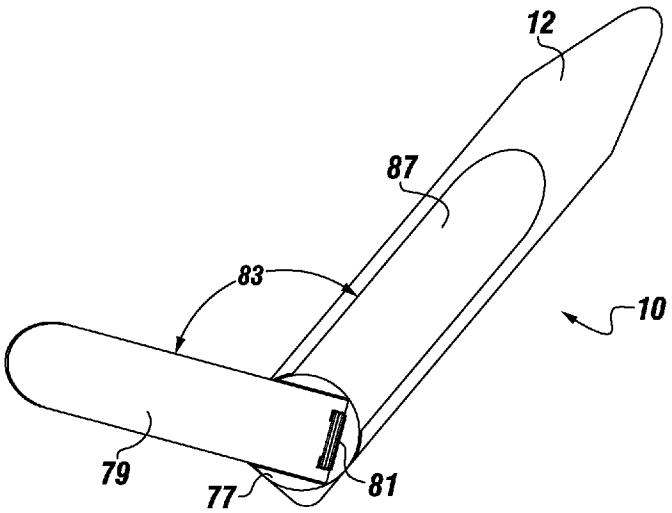
FIGS. 7A-7C are depictions of the adjustable collar stay with a stabilizing arm.
Figure 7A:
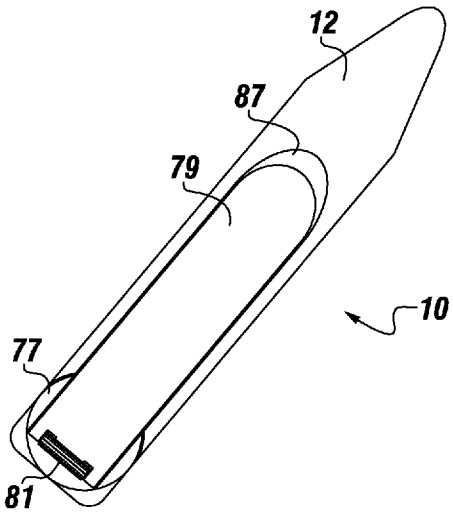
Figure 7C:
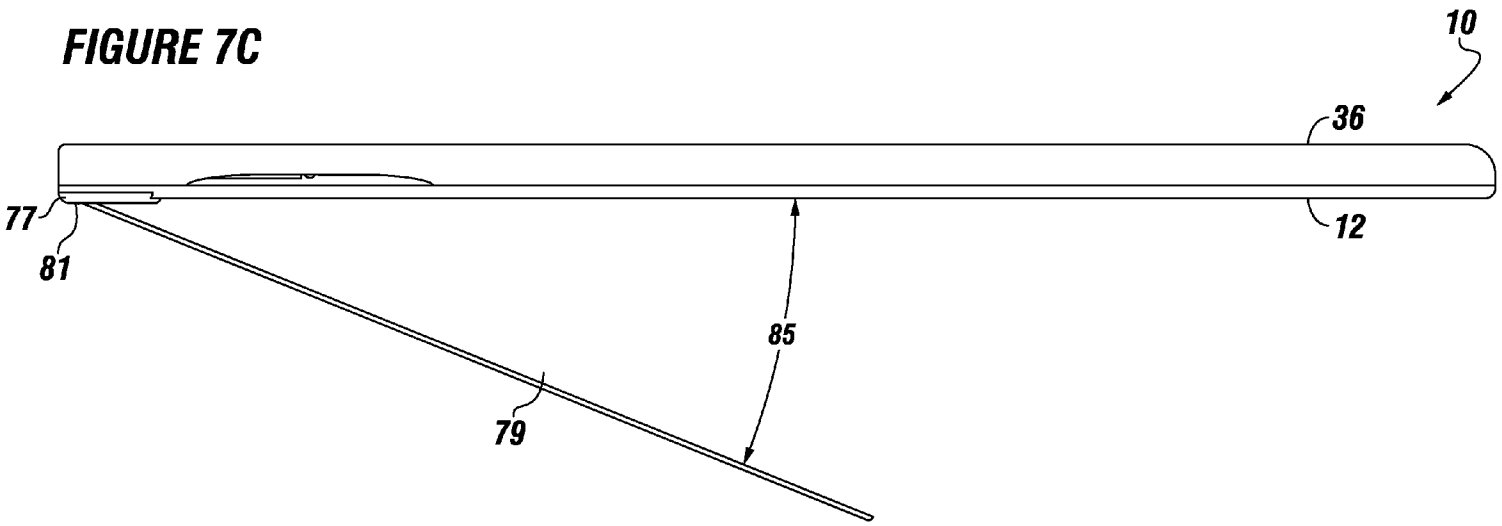

FIGS. 7A-7C depict an embodiment of the adjustable collar stay 10 having the lower member 12 and the upper member 36.

A disc 77 can be rotatably attached to the lower member 12. A stabilizing arm 79 can be pivotably connected to the disc 77 with a ratcheting mechanism 81 for locking a position of the stabilizing arm 79.

In operation, the ratcheting mechanism 81 can be used to lock a position of the stabilizing arm 79 along a pivoting arc 85.

The lower member 12 can include a lower member recessed portion 87. The stabilizing arm 79 can engage within the lower member recessed portion 87. The stabilizing arm 79 can be rotatable about a rotational arc 83.

Figure 8A:
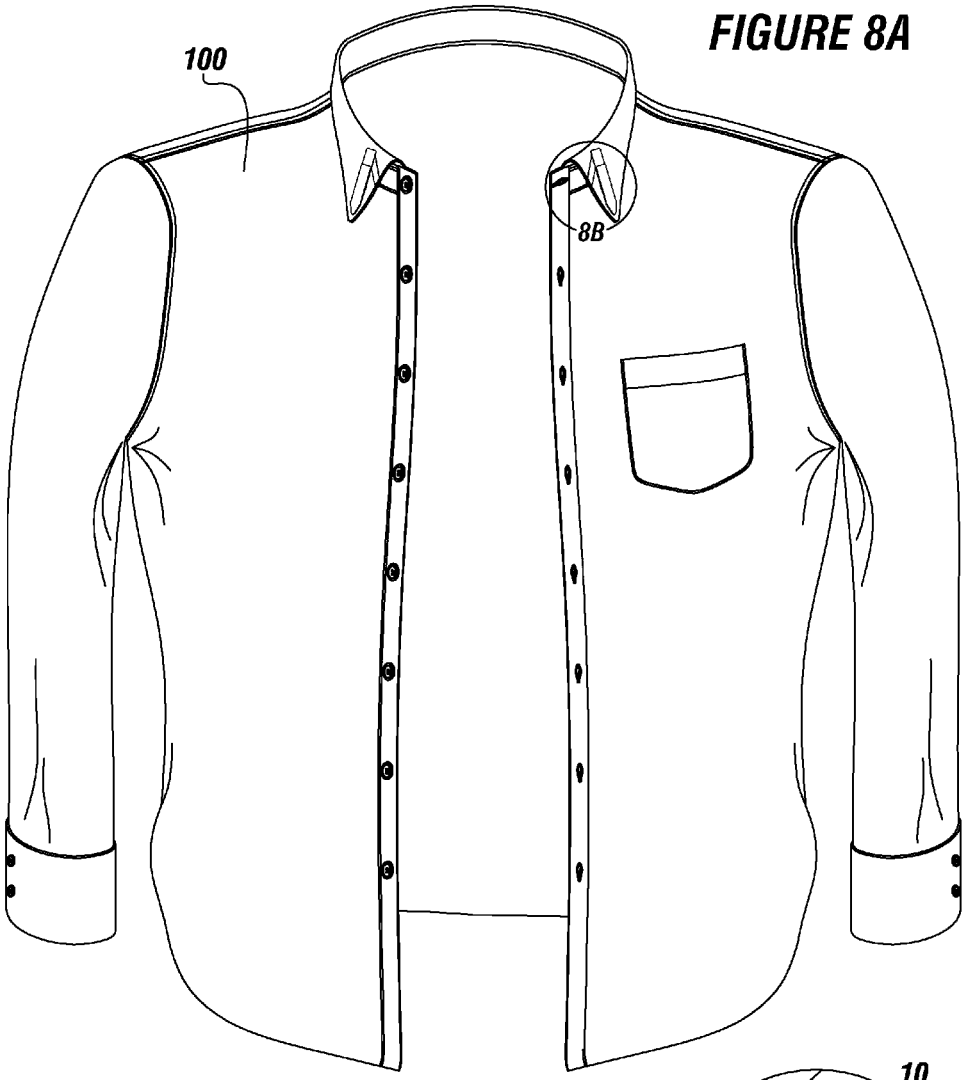
FIGS. 8A-8B depict a shirt with the adjustable collar stay inserted therein.
Figure 8B:
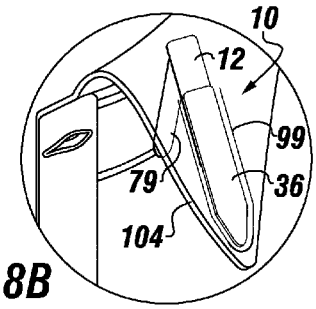

FIGS. 8A-8B depict an embodiment of a shirt 100 with collar 104.

The collar 104 can have a collar stay slot 99. The adjustable collar stay 10 can be engaged within the collar stay slot 99. For example, the upper member 36 can be fully engaged within the collar stay slot 99, and the lower member 12 can be partially extending out of the collar stay slot 99.

The stabilizing arm 79 can be disposed outside of the collar stay slot 99 and can be engaging the shirt 100. In operation, the ratcheting mechanism, not shown in this Figure, and the stabilizing arm 79 can be used to adjust a position of the collar 104. The ratcheting mechanism and stabilizing arm 79 can be used to hold the position of the collar 104, such as during windy weather conditions.

In one or more embodiments, the stabilizing arm 79 can be engaged on an outside surface of the collar stay slot 99 and can function to securely hold the adjustable collar stay 10 within the collar stay slot 99.

As such, the adjustable collar stay 10 can be insertable into the collar stay slot 99 for maintaining a position of the collar 104.

Figures 9A, 9B, 9C:
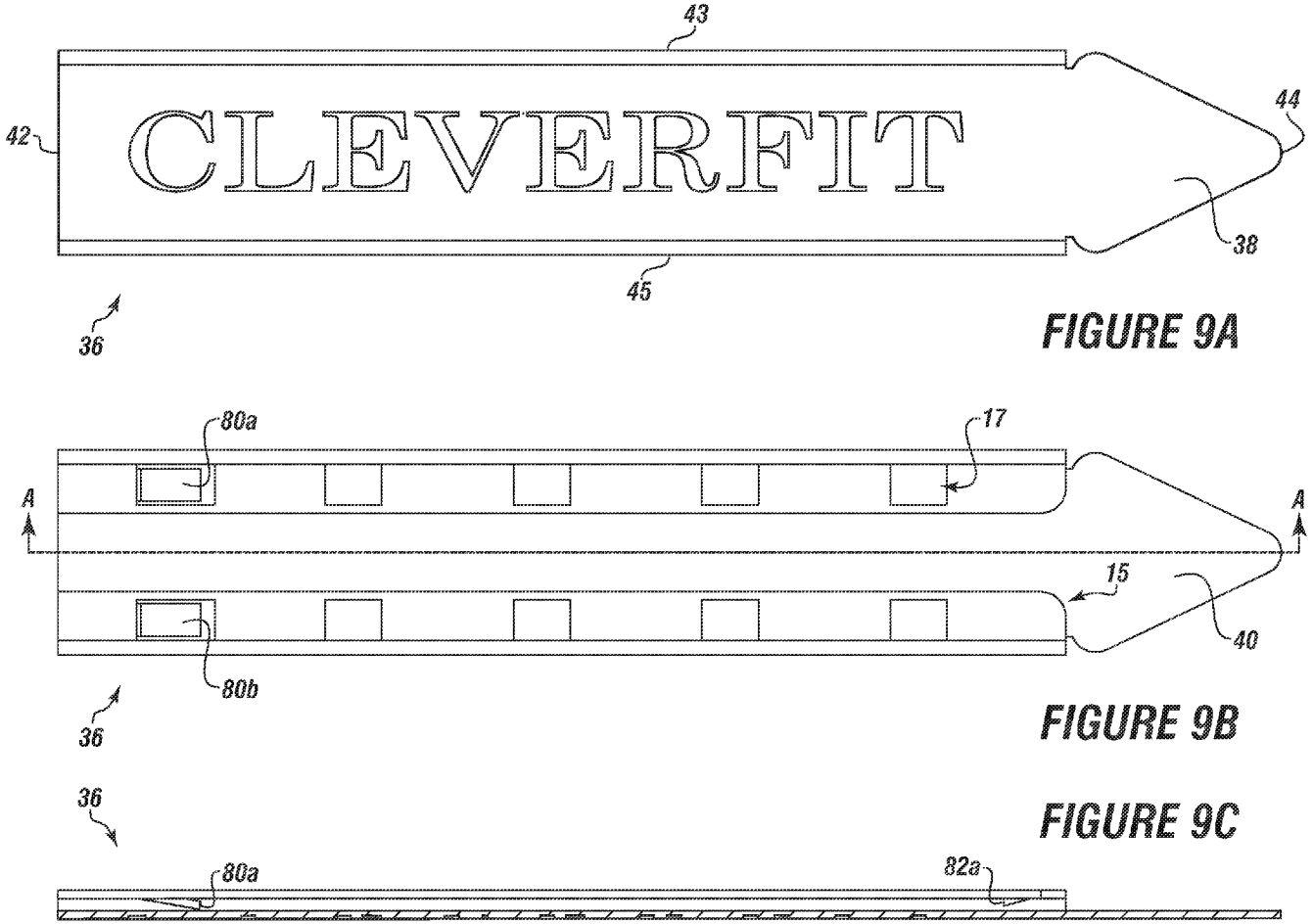
FIGS. 9A-9C depict an embodiment of the upper member.

FIG. 9A depicts a top view of the upper member 36, FIG. 9B depicts a bottom view of the upper member 36, and FIG. 9C depicts a cut side view along line A-A of the upper member 36.

The upper member 36 can include the upper member top surface 38, upper member bottom surface 40 opposite the upper member top surface 38, the upper member back end 42, and the upper member tapered front end 44 opposite the upper member back end 42.

The upper member 36 can include an upper member first side 43 connecting between the upper member back end 42 and the upper member tapered front end 44, and between the upper member top surface 38 and upper member bottom surface 40.

The upper member 36 can include an upper member second side 45 connecting between the upper member back end 42 and the upper member tapered front end 44, and between the upper member top surface 38 and upper member bottom surface 40 opposite the upper member first side 43.

The upper member 36 can include an upper engagement mechanism 15, such as a set of sliding track arms, for movably engaging the lower member.

In one or more embodiments, the upper engagement mechanism 15 can be connected to or formed on a portion of the upper member. For example, the upper engagement mechanism 15 can be connected to or formed on a portion of: the upper member top surface 38, the upper member bottom surface 40, the upper member back end 42, the upper member tapered front end 44, the upper member first side 43, the upper member second side 45, or combinations thereof.

The upper member 36 can include an upper locking mechanism 17, such as a plurality of engagement and resistance sites, for locking with the lower member.

In one or more embodiments, the upper locking mechanism 17 can be connected to a portion of: the upper member top surface 38, the upper member bottom surface 40, the upper member back end 42, the upper member tapered front end 44, the upper member first side 43, the upper member second side 45, the upper engagement mechanism 15, or combinations thereof.

The upper member 36 can include one or more back stops 80*a* and 80*b* for restraining extension and retraction of the upper member 36 from the lower member.

The one or more back stops 80*a* and 80*b* can be formed on the upper engagement mechanism 15. In operation, the one or more back stops 80*a* and 80*b* can be configured to engage with a portion of the lower member to prevent over extension and dislocation of the upper member 36 from the lower member. For example, during extension of the upper member 36 relative to the lower member, the one or more back stops 80*a* and 80*b* can engage with one or more stop engagement portions, shown in detail in FIGS. 10A-10B, of the lower member to prevent further extension.

The upper member 36 can also include one or more front stops 82*a* for restraining extension and retraction of the upper member 36 from the lower member.

The one or more front stops 82*a* can be formed on the upper engagement mechanism 15. The one or more front stops 82*a* can be configured to engage with a portion of the lower member to prevent movement of the upper member 36 past a fully retracted position relative to the lower member, and to prevent dislocation of the upper member 36 from the lower member. For example, during retraction of the upper member 36 relative to the lower member, the one or more front stops 82*a* can engage with one or more stop engagement portions, shown in later Figures, of the lower member to prevent further retraction.

Figure 10A:
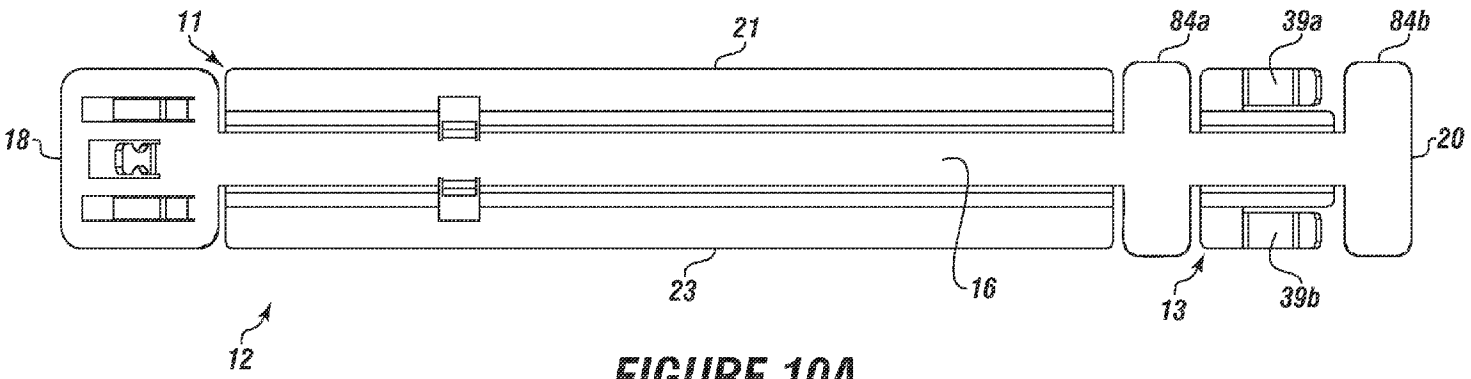
FIGS. 10A-10B depict an embodiment of the lower member.
Figure 10B:
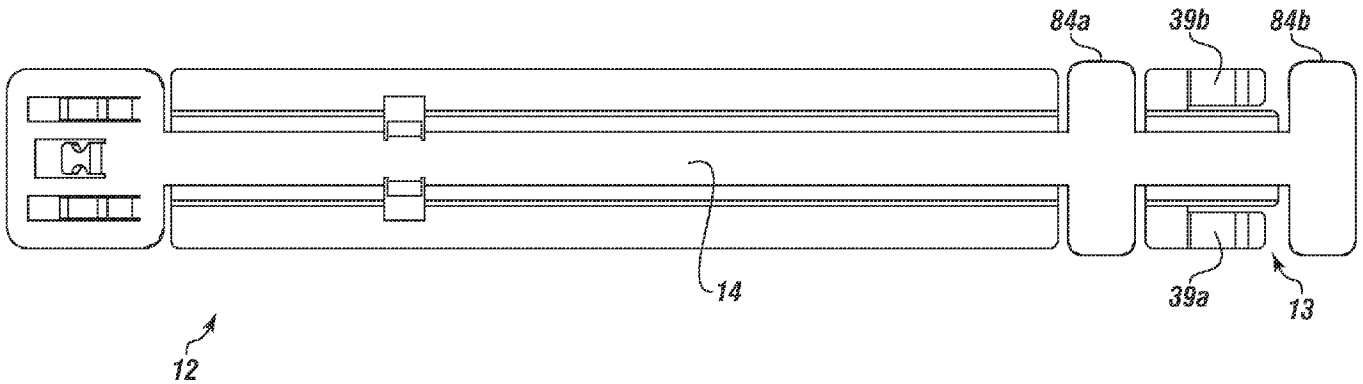

FIGS. 10A-10B depict an embodiment of the lower member 12 according to one or more embodiments.

The lower member 12 is shown with the lower member top surface 14, lower member bottom surface 16 opposite the lower member top surface 14, and lower member back end 18, and lower member front end 20 opposite the lower member back end 18.

The lower member 12 is shown with the lower member first side 21 connecting between the lower member back end 18 and the lower member front end 20, and between the lower member top surface 14 and the lower member bottom surface 16.

The lower member 12 is shown with the lower member second side 23 connecting between the lower member back end 18 and the lower member front end 20, and between the lower member top surface 14 and the lower member bottom surface 16 opposite the lower member first side 21.

The lower member 12 can have a lower engagement mechanism 11, such as a set of track arms, for engaging with the upper member.

In one or more embodiments, the lower engagement mechanism 11 can be connected to: the lower member top surface 14, lower member bottom surface 16, lower member back end 18, the lower member front end 20, the lower member first side 21, the lower member second side 23, or combinations thereof.

The lower member 12 can have a lower locking mechanism 13, such as a first locking tab 39*a* and second locking tab 39*b*, for locking with the upper member.

The first locking tab 39*a* can be disposed along a portion of the lower member first side 21, and the second locking tab 39*b* can be disposed along a portion of the lower member second side 23.

In one or more embodiments, the lower locking mechanism 13 can be connected to: the lower member top surface 14, lower member bottom surface 16, lower member back end 18, lower member front end 20, lower member first side 21, lower member second side 23, or combinations thereof. For example, the first locking tab 39*a* and second locking tab 39*b* can extend from the lower member bottom surface 16 proximate the lower member first side 21 and lower member second side 23.

The lower member 12 can have one or more stop engagement portions 84*a* and 84*b* for engaging with the back stop and front stop of the upper member.

FIGS. 11 and 12 depict the adjustable collar stay 10 according to one or more embodiments.

The lower member of the adjustable collar stay 10 can have the lower engagement mechanism, which can include a first lower track arm 19*a* disposed along a portion of the lower member first side and a second lower track arm 19*b* disposed along a portion of the lower member second side. The first lower track arm 19*a* and second lower track arm 19*b* can both extend from the lower member bottom surface 16, and can be L-shaped.

The upper member of the adjustable collar stay 10 can include the upper engagement mechanism, including a first upper track arm 25*a* disposed along a portion of the upper member first side. The first upper track arm 25*a* is shown with the first upper side extension 48 connected to a first upper lip 52.

The upper engagement mechanism can include a second upper track arm 25*b* disposed along a portion of the upper member second side. The second upper track arm 25*b* is shown with the second upper side extension 50 connected to the second upper lip 54.

In operation, the first lower track arm 19*a* can be configured to movably engage over the first upper track arm 25*a*, and the second lower track arm 19*b* can be configured to movably engage over the second upper track arm 25*b*.

The upper member of the adjustable collar stay 10 can include the upper locking mechanism, including a plurality of engagement and resistance sites, such as engagement and resistance sites 34*a* and 34*b*. The plurality of engagement and resistance sites 34*a* and 34*b* can be disposed along the first upper side extension 48 or the first lip 52, and along the second upper side extension 50 or the second lip 54.

In operation, the first locking tab 39*a* can be configured to engage within the engagement and resistance sites along the first upper track arm 25*a*, such as the engagement and resistance site 34*a*. The second locking tab 39*b* can be configured to engage within the engagement and resistance sites along the second upper track arm 25*b*, such as the engagement and resistance site 34*b*.

For example, the first locking tab 39*a* and second locking tab 39*b* can each have a curved portion that extends into one of the plurality of engagement and resistance sites 34*a* and 34*b*.

In operation, a user can apply enough force to disengage the first locking tab 39*a* and second locking tab 39*b* from one the plurality of engagement and resistance sites 34*a* and 34*b* to move the upper member relative to the lower member and extend and retract the adjustable collar stay 10. As such, the upper locking mechanism can be configured to engage with the lower locking mechanism to maintain a degree of extension of the upper member relative to the lower member.

In one or more embodiment, the adjustable collar stay 10 can include a lower locking mechanism having a single locking tab disposed along a portion of the lower member, and the upper locking mechanism can include a plurality of engagement and resistance sites disposed along a portion of the upper member. The single locking tab can be configured to engage within one of the plurality of engagement and resistance sites.

The stabilizing arm 79 can be connected to the lower member bottom surface 16 proximate the lower member back end. For example, a stabilizing arm connector 86 can extend from the lower member bottom surface 16 to engage with the stabilizing arm 79.

In operation, the stabilizing arm 79 can be retained parallel to the lower member bottom surface 16 by one or more stabilizing arm tabs 88. The stabilizing arm 79 can be pivotable from the lower member bottom surface 16 to extend therefrom.

The stabilizing arm 79 can be used to stabilize and orient a position of a collar having the adjustable collar stay 10 inserted therein.

The connection of the stabilizing arm 79 to the lower member bottom surface 16 can include the ratcheting mechanism 81. In operation, as the stabilizing arm 79 pivots from the lower member bottom surface 16, the ratcheting mechanism 81 can engage the stabilizing arm 79 to lock a position of the stabilizing arm 79 along a pivoting arc.

In one or more embodiments, the stabilizing arm 79 can be rotatably connected to the lower member bottom surface 16.

Also shown is the upper member bottom surface 40, the lower member front end 20, one or more stop engagement portions 84*a* and 84*b*, the lower member top surface 14, and the upper member top surface 38.

Figure 13:
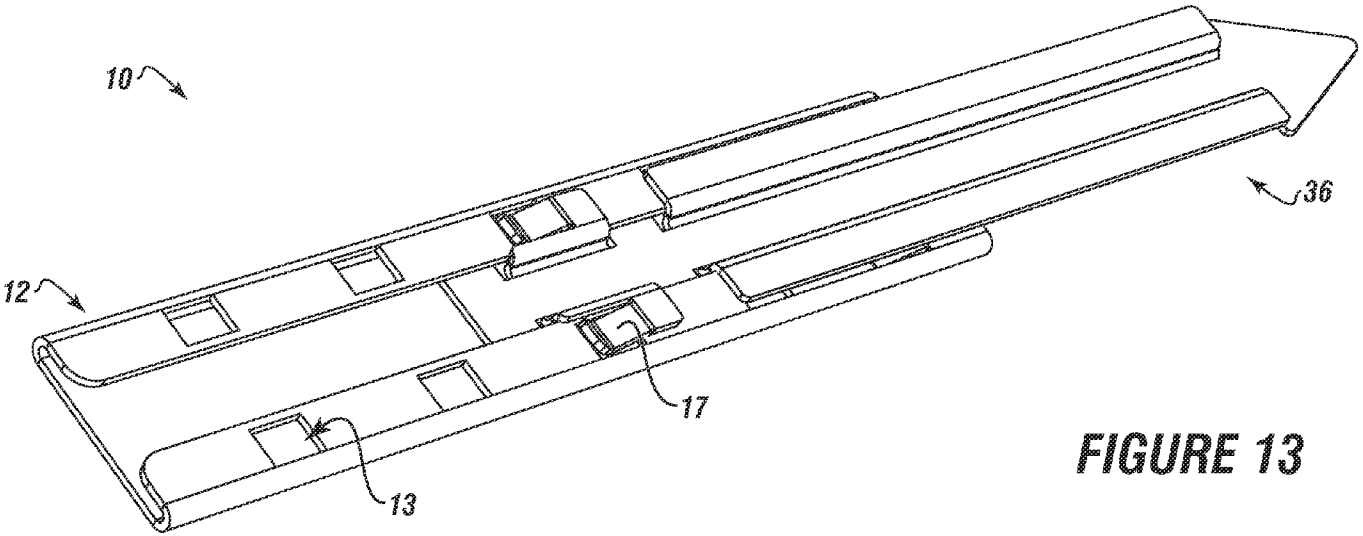
FIG. 13 depicts another embodiment of the adjustable collar stay.

FIG. 13 depicts the adjustable collar stay 10 according to one or more embodiments.

The upper member 36 is shown engaged with the lower member 12. The upper member 36 is shown with an upper locking mechanism 17, shown here as a locking tab. The upper locking mechanism 17 can be formed substantially similar to the lower locking mechanism depicted in FIGS. 10A-10B.

The lower member 12 is shown with the lower locking mechanism 13, shown here as a plurality of engagement and resistance sites. The lower locking mechanism 13 can be formed substantially similar to the upper locking mechanism depicted in FIGS. 9A-9C.

The upper locking mechanism 17 can be configured to be engaged with the lower locking mechanism 13.

Figure 14:
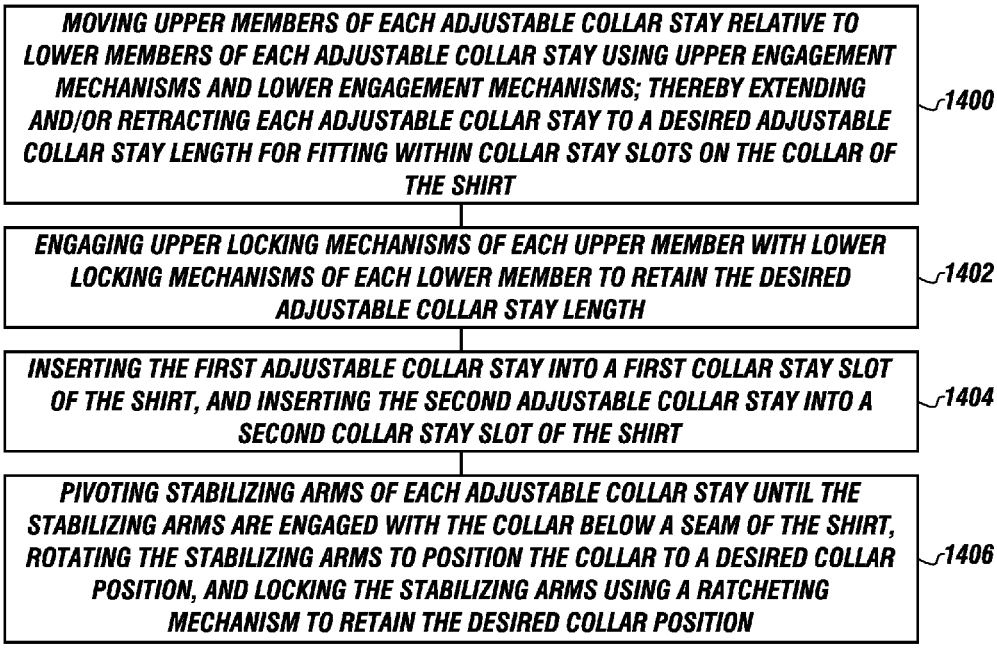
FIG. 14 depicts a method for using the adjustable collar stay.

FIG. 14 depicts an embodiment of a method for stiffening a collar of a shirt using a first adjustable collar stay and a second adjustable collar stay.

The method can include moving upper members of each adjustable collar stay relative to lower members of each adjustable collar stay using upper engagement mechanisms and lower engagement mechanisms; thereby extending and/or retracting each adjustable collar stay to a desired adjustable collar stay length for fitting within collar stay slots on the collar of the shirt, as illustrated by box 1400.

The method can include engaging upper locking mechanisms of each upper member with lower locking mechanisms of each lower member to retain the desired adjustable collar stay length, as illustrated by box 1402.

The method can include inserting the first adjustable collar stay into a first collar stay slot of the shirt, and inserting the second adjustable collar stay into a second collar stay slot of the shirt, as illustrated by box 1404.

The method can include pivoting stabilizing arms of each adjustable collar stay until the stabilizing arms are engaged with the collar below a seam of the shirt, rotating the stabilizing arms to position the collar to a desired collar position, and locking the stabilizing arms using a ratcheting mechanism to retain the desired collar position, as illustrated by box 1406.

While these embodiments have been described with emphasis on the embodiments, it should be understood that within the scope of the appended claims, the embodiments might be practiced other than as specifically described herein.

What is claimed is:

1. An adjustable collar stay comprising:

(a) a lower member comprising:

(i) a lower member top surface, a lower member bottom surface opposite the lower member top surface, a lower member back end, and a lower member front end opposite the lower member back end;

(ii) a lower member first side connecting between the lower member back end and the lower member front end, and between the lower member top surface and the lower member bottom surface;

(iii) a lower member second side connecting between the lower member back end and the lower member front end, and between the lower member top surface and the lower member bottom surface opposite the lower member first side;

(iv) a lower engagement mechanism connected to or formed on: the lower member top surface, the lower member bottom surface, the lower member back end, the lower member front end, the lower member first side, the lower member second side, or combinations thereof, wherein the lower engagement mechanism comprises:

1) a first lower track arm disposed along a portion of the lower member first side; and 2) a second lower track arm disposed along a portion of the lower member second side; and (v) a lower locking mechanism connected to or formed on: the lower member top surface, the lower member bottom surface, the lower member back end, the lower member front end, the lower member first side, the lower member second side, or combinations thereof; and (b) an upper member for extendable and retractable engagement with the lower member, wherein the upper member comprises:

(i) an upper member top surface, an upper member bottom surface opposite the upper member top surface, an upper member back end, and an upper member tapered front end opposite the upper member back end;

(ii) an upper member first side connecting between the upper member back end and the upper member tapered front end, and between the upper member top surface and the upper member bottom surface;

(iii) an upper member second side connecting between the upper member back end and the upper member tapered front end, and between the upper member top surface and the upper member bottom surface opposite the upper member first side;

(iv) an upper engagement mechanism connected to or formed on a portion of: the upper member top surface, the upper member bottom surface, the upper member back end, the upper member tapered front end, the upper member first side, the upper member second side, or combinations thereof, wherein the upper engagement mechanism is configured to movably engage with the lower engagement mechanism, wherein the upper engagement mechanism comprises:

1) a first upper track arm disposed along a portion of the upper member first side, wherein the first upper track arm comprises a first upper side extension connected to a first upper lip; and 2) a second upper track arm disposed along a portion of the upper member second side, wherein the second upper track arm comprises a second upper side extension connected to a second upper lip, and wherein the first lower track arm is configured to engage over the first upper track arm and the second lower track arm is configured to engage over the second upper track arm; and (v) an upper locking mechanism connected to or formed on a portion of: the upper member top surface, the upper member bottom surface, the upper member back end, the upper member tapered front end, the upper member first side, the upper member second side, the upper engagement mechanism, or combinations thereof, wherein the upper locking mechanism is configured to engage with the lower locking mechanism to maintain a degree of extension of the upper member relative to the lower member.

2. The adjustable collar stay of claim 1, wherein:

(a) the lower locking mechanism comprises:

(i) a first locking tab disposed along a portion of the lower member first side; and (ii) a second locking tab disposed along a portion of the lower member second side; and (b) the upper locking mechanism comprises:

(i) a first plurality of engagement and resistance sites disposed along the first side extension or the first lip of the first upper track arm; and (ii) a second plurality of engagement and resistance sites disposed along the second side extension or the second lip of the second upper track arm, wherein the first locking tab is configured to engage within one of the first plurality of engagement and resistance sites, and wherein the second locking tab is configured to engage within one of the second plurality of engagement and resistance sites.

3. The adjustable collar stay of claim 1, wherein:

(a) the lower locking mechanism comprises a locking tab disposed along a portion of the lower member; and (b) the upper locking mechanism comprises a plurality of engagement and resistance sites disposed along a portion of the upper member, wherein the locking tab is configured to engage within one of the plurality of engagement and resistance sites.

4. The adjustable collar stay of claim 1, further comprising:
(a) a back stop formed on the upper engagement mechanism, wherein the back stop is configured to engage with a portion of the lower member to prevent over extension and dislocation of the upper member from the lower member;
(b) a front stop formed on the upper engagement mechanism, wherein the front stop is configured to engage with a portion of the lower member to prevent movement of the upper member past a fully retracted position relative to the lower member and to prevent dislocation of the upper member from the lower member; or
(c) combinations thereof.

5. The adjustable collar stay of claim 1, wherein:
(a) the lower engagement mechanism comprises:
(i) a first lower track arm disposed along a portion of the lower member first side, wherein the first lower track arm comprises a first lower side extension connected to a first lower lip; and
(ii) a second lower track arm disposed along a portion of the lower member second side, wherein the second lower track arm comprises a second lower side extension connected to a second lower lip; and
(b) the upper engagement mechanism comprises:
(i) a first upper track arm disposed along a portion of the upper member first side; and
(ii) a second upper track arm disposed along a portion of the upper member second side, wherein the first upper track arm is configured to engage over the first lower track arm and the second upper track arm is configured to engage over the second lower track arm.

6. The adjustable collar stay of claim 5, wherein:
(a) the upper locking mechanism comprises:
(i) a first locking tab disposed along a portion of the upper member first side; and
(ii) a second locking tab disposed along a portion of the upper member second side; and
(b) the lower locking mechanism comprises:
(i) a first plurality of engagement and resistance sites disposed along the first lower side extension or the first lower lip of the first lower track arm; and
(ii) a second plurality of engagement and resistance sites disposed along the second lower side extension or the second lower lip of the second lower track arm, wherein the first locking tab is configured to engage within one of the first plurality of engagement and resistance sites, and wherein the second locking tab is configured to engage within one of the second plurality of engagement and resistance sites.

7. The adjustable collar stay of claim 5, wherein:
(a) the upper locking mechanism comprises a locking tab disposed along a portion of the upper member; and
(b) the lower locking mechanism comprises a plurality of engagement and resistance sites disposed along a portion of the lower member, wherein the locking tab is configured to engage within one of the plurality of engagement and resistance sites.

8. The adjustable collar stay of claim 5, further comprising:
(a) a back stop formed on the lower engagement mechanism, wherein the back stop is configured to engage with a portion of the upper member to prevent over extension and dislocation of the upper member from the lower member;
(b) a front stop formed on the lower engagement mechanism, wherein the front stop is configured to engage with a portion of the upper member to prevent movement of the upper member past a fully retracted position relative to the lower member and to prevent dislocation of the upper member from the lower member; or
(c) combinations thereof.

9. The adjustable collar stay of claim 1, wherein:
(a) the lower engagement mechanism comprises a raised portion connected to or formed on the lower member top surface between the lower member back end and the lower member front end, wherein the lower member front end is tapered, and wherein the raised portion comprises:
1) a raised portion first side;
2) a raised portion second side; and
3) a raised portion top side, wherein the raised portion is disposed between the lower member first side and the lower member second side, thereby forming a first ledge on the lower member top surface between the raised portion and the lower member first side, and forming a second ledge on the lower member top surface between the raised portion and the lower member second side;
(b) the lower member locking mechanism comprises:
(i) a first channel formed within the raised portion first side;
(ii) a second channel formed within the raised portion second side; and
(iii) a plurality of engagement and resistance sites formed within the first channel, the second channel, or combinations thereof, wherein a height of the first channel and the second channel is smaller proximate the lower member back end;
(c) the upper engagement mechanism comprises:
(i) a first upper side extension connected to and extending perpendicular from the upper member first side, wherein the first upper side extension extends below the upper member bottom surface;
(ii) a second upper side extension connected to and extending perpendicular from the upper member second side, wherein the second side upper extension extends below the upper member bottom surface;
(iii) a first upper lip connected to the first upper side extension opposite the upper member first side, wherein the first upper lip extends perpendicular to the first upper side extension and towards the second upper side extension, and wherein the first upper lip is configured to slidingly engage within the first channel;
(iv) a second upper lip connected to the second upper side extension opposite the upper member second side, wherein the second upper lip extends perpendicular to the second upper side extension and towards the first upper side extension, and wherein the second upper lip is configured to slidingly engage within the second channel;
(v) a first recessed portion formed within the first upper side extension and the first upper lip; and
(vi) a second recessed portion formed with in the second upper side extension and the second upper lip;
(d) the upper locking mechanism comprises: a first locking means disposed on or connected to an inner surface of the first upper side extension at the first recessed portion, a second locking means disposed on or connected to an inner surface of the second upper side extension at the second recessed portion, or combinations thereof, wherein the first locking means is configured to sequentially engage one of the plurality of engagement and resistance sites within the first channel, the second locking means is configured to sequentially engage one of the plurality of engagement and resistance sites within the second channel, or combinations thereof; and (e) the upper member comprises a compression site formed on the upper member top surface over the first locking means, the second locking means, or combinations thereof, wherein the compression site is configured to allow the upper member to be mechanically compressed towards the lower member, and wherein:

(i) a cavity having a dimension is formed between the upper member bottom surface and the raised portion top side;

(ii) upon mechanical compression of the upper member towards the lower member, the upper member extends into the cavity and the raised portion top side prevents compression of the upper member beyond the dimension of the cavity; and (iii) the dimension of the cavity is configured to allow the first locking means, the second locking means, or combinations thereof to disengage from one of the plurality of engagement and resistance sites upon mechanical compression of the upper member for moving the upper member within the first channel and the second channel, and for engaging the first locking means, the second locking means, or combinations thereof with another of the plurality of engagement and resistance sites.

10. The adjustable collar stay of claim 9, wherein the smaller height of the first channel, the second channel, or combinations thereof proximate the lower member back end is less than a height of the first locking means, the second locking means, or combinations thereof, thereby forming a back stop to prevent movement of the first locking means, the second locking means, or combinations thereof in a first direction beyond the back stop, and wherein the adjustable collar stay further comprises a front stop formed in the first channel, the second channel, or combinations thereof opposite the back stop to prevent movement of the first locking means, the second locking means, or combinations thereof in a second direction beyond the front stop.

11. The adjustable collar stay of claim 9, wherein the plurality of engagement and resistance sites are teeth-like structures, gear-like structures, bumps, recessed portions, or grooves.

12. The adjustable collar stay of claim 9, wherein the compression site is a depression within the upper member top surface.

13. The adjustable collar stay of claim 9, wherein upon mechanical compression of the upper member:

(a) the first ledge engages the first upper lip; and (b) the second ledge engages the second upper lip, thereby resistively stabilizing the upper member on the lower member and allowing the upper member to compressively extend or flex into the cavity.

14. The adjustable collar stay of claim 9, wherein upper member is configured to movingly retract and extend within the first channel and the second channel to allow the adjustable collar stay to have a length ranging from 0.5 inches in a retracted position to 5 inches in an extended position.

15. The adjustable collar stay of claim 1, wherein the adjustable collar stay is made of stainless steel, a zinc alloy, an aluminum alloy, a ferrous metal, a non-ferrous metal, a non-deforming plastic, a compressible plastic, a flexible plastic, another plastic, a polymer, a reinforced polymer, a coated polymer, or combinations thereof.

16. The adjustable collar stay of claim 1, further comprising a stabilizing arm connected to the lower member bottom surface proximate the lower member back end, wherein the stabilizing arm is pivotable from the lower member bottom surface to stabilize and orient a position of a collar having the adjustable collar stay inserted therein.

17. The adjustable collar stay of claim 16, wherein the stabilizing arm is rotatably connected to the lower member bottom surface.

18. The adjustable collar stay of claim 16, wherein the connection of the stabilizing arm to the lower member bottom surface comprises a ratcheting mechanism for locking a position of the stabilizing arm along a pivoting arc of the stabilizing arm.

19. An adjustable collar stay comprising:

(a) a lower member comprising:

(i) a lower engagement mechanism connected to or formed onto a portion of the lower member, wherein the lower engagement mechanism comprises:

1) a first lower track arm disposed along a portion of the lower member first side; and 2) a second lower track arm disposed along a portion of the lower member second side; and (ii) a lower locking mechanism connected to or formed on a portion of the lower member; and (b) an upper member for extendable and retractable engagement with the lower member, wherein the upper member comprises:

(i) an upper engagement mechanism connected to or formed on a portion of the upper member, wherein the upper engagement mechanism is configured to movably engage with the lower engagement mechanism, wherein the upper engagement mechanism comprises:

1) a first upper track arm disposed along a portion of the upper member first side, wherein the first upper track arm comprises a first upper side extension connected to a first upper lip; and 2) a second upper track arm disposed along a portion of the upper member second side, wherein the second upper track arm comprises a second upper side extension connected to a second upper lip, and wherein the first lower track arm is configured to engage over the first upper track arm and the second lower track arm is configured to engage over the second upper track arm; and (ii) an upper locking mechanism connected to or formed on a portion of the upper member, wherein the upper locking mechanism is configured to engage with the lower locking mechanism to maintain a degree of extension of the upper member relative to the lower member, and wherein the adjustable collar stay is insertable into a collar stay slot of a shirt collar for maintaining a position of the shirt collar.

* * * * *